US008077892B2

(12) United States Patent
Dijkstra et al.

(10) Patent No.: US 8,077,892 B2
(45) **Date of Patent: *Dec. 13, 2011**

(54) HEARING ASSISTANCE SYSTEM INCLUDING DATA LOGGING CAPABILITY AND METHOD OF OPERATING THE SAME

(75) Inventors: Evert Dijkstra, Fontaines (CH); Francois Marquis, Oron-le-Chatel (CH)

(73) Assignee: Phonak AG, Staefa (CH)

( * ) Notice: Subject to any disclaimer, the term of this patent is extended or adjusted under 35 U.S.C. 154(b) by 1374 days.

This patent is subject to a terminal disclaimer.

(21) Appl. No.: 11/554,107

(22) Filed: Oct. 30, 2006

(65) Prior Publication Data

US 2008/0101635 A1 May 1, 2008

(51) Int. Cl.
*H04R 25/00* (2006.01)

(52) U.S. Cl. ..... 381/315; 381/312

(58) Field of Classification Search ..... 381/312, 381/314–315, 331; 379/56.1–3; 455/556.1
See application file for complete search history.

(56) References Cited

U.S. PATENT DOCUMENTS

| | | | | |
|---|---|---|---|---|
| 4,972,487 | A | 11/1990 | Mangold et al. | |
| 6,115,478 | A * | 9/2000 | Schneider | 381/314 |
| 6,741,712 | B2 | 5/2004 | Bisgaard | |
| 6,785,394 | B1 | 8/2004 | Olsen et al. | |
| 7,639,828 | B2 * | 12/2009 | Platz | 381/315 |
| 7,778,432 | B2 * | 8/2010 | Larsen | 381/315 |
| 7,783,067 | B1 * | 8/2010 | Frerking et al. | 381/315 |
| 2004/0190737 | A1 | 9/2004 | Kuhnel et al. | |
| 2004/0190739 | A1 | 9/2004 | Bachler et al. | |
| 2006/0182295 | A1 | 8/2006 | Dijkstra et al. | |
| 2006/0204024 | A1 | 9/2006 | Eicher | |
| 2006/0222194 | A1 | 10/2006 | Bramslow et al. | |

FOREIGN PATENT DOCUMENTS

| | | | |
|---|---|---|---|
| EP | 1367857 | A1 | 12/2003 |
| EP | 1638367 | A2 | 3/2006 |
| WO | 9721325 | A1 | 6/1997 |
| WO | 0223948 | A1 | 3/2002 |
| WO | 2006/074655 | A1 | 7/2006 |

* cited by examiner

*Primary Examiner* — Suhan Ni

(74) *Attorney, Agent, or Firm* — Roberts Mlotkowski Safran & Cole, P.C.; David S. Safran

(57) ABSTRACT

There is provided a method of operating a system for providing hearing assistance to a user (101), comprising: capturing and processing audio signals by a transmission unit (102) and transmitting the audio signals from the transmission unit (102) via a wireless audio link to a receiver unit (103); processing the received audio signals in the receiver unit (103); stimulating the user's hearing, by stimulating means (38, 136) worn at or in the user's ear, according to the audio signals from the receiver unit (103); logging data by recording the values of at least one operation parameter of the transmission unit (102) and/or the receiver unit (103) as a function of time and/or by recording data derived from the values of at least one operation parameter of the transmission unit (102) and/or the receiver unit (103) as a function of time in the transmission unit (102); and reading the logged data from the transmission unit (102).

20 Claims, 6 Drawing Sheets

HEARING ASSISTANCE SYSTEM INCLUDING DATA LOGGING CAPABILITY AND METHOD OF OPERATING THE SAME

BACKGROUND OF THE INVENTION

1. Field of the Invention

The present invention relates to a method of operating a system for providing hearing assistance to a user comprising capturing and processing audio signals by a transmission unit and transmitting the audio signals from the transmission unit via wireless audio link to a receiver unit; processing the received audio signals in the receiver unit; and stimulating the user's hearing by stimulating means worn at or in the user's ear, according to the audio signals from the receiver unit. The invention also relates to such a system.

2. Description of Related Art

Usually in such systems the wireless audio link is an FM radio link. The benefit of such systems is that sound captured by a remote microphone at the transmission unit can be presented at a high sound pressure level to the hearing of the user wearing the receiver unit at his ear(s).

According to one typical application of such wireless audio systems, the stimulating means is a loudspeaker which is part of the receiver unit or is connected thereto. Such systems are particularly helpful for being used in teaching e.g. (a) normal-hearing children suffering from auditory processing disorders (APD), (b) children suffering a unilateral loss (one dead ear), or (c) children with a mild hearing loss, wherein the teacher's voice is captured by the microphone of the transmission unit, and the corresponding audio signals are transmitted to and reproduced by the receiver unit worn by the child, so that the teacher's voice can be heard by the child at an enhanced level, in particular with respect to the background noise level prevailing in the classroom. It is well known that presentation of the teacher's voice at such enhanced level supports the child in listening to the teacher.

Usually in such systems the audio signals received by the receiver are amplified at a given constant gain for being reproduced by the output transducer. Such receiver unit has as a drawback that due to the constant gain the audio signals received from the remote microphone are amplified irrespective of whether they are desired by the user (e.g. if the teacher is silent there is no benefit to the user by receiving audio signals from the remote microphone, which then may consist primarily of noise).

According to another typical application of wireless audio systems the receiver unit is connected to or integrated into a hearing instrument, such as a hearing aid. The benefit of such systems is that the microphone of the hearing instrument can be supplemented or replaced by the remote microphone which produces audio signals which are transmitted wirelessly to the FM receiver and thus to the hearing instrument. FM systems have been standard equipment for children with hearing loss (wearing hearing aids) and deaf children (implanted with a cochlear implant) in educational settings for many years.

Hearing impaired adults are also increasingly using FM systems. They typically use a sophisticated transmitter which can (a) be pointed to the audiosource of interest (in e.g. cocktail parties, (b) put on a table (e.g. in a restaurant or a business meeting), or (c) put around the neck of a partner/speaker and receivers that are connected to or integrated into the hearing aids. Some transmitters even have an integrated Bluetooth module given the hearing impaired adult the possibility to connect wirelessly with devices such as cell phones, laptops etc.

The merit of wireless audio systems lies in the fact that a microphone placed a few inches from the mouth of a person speaking receives speech at a much higher level than one placed several feet away. This increase in speech level corresponds to an increase in signal-to-noise ratio (SNR) due to the direct wireless connection to the listener's amplification system. The resulting improvements of signal level and SNR in the listener's ear are recognized as the primary benefits of FM radio systems, as hearing-impaired individuals are at a significant disadvantage when processing signals with a poor acoustical SNR.

In order to provide versatile systems that cover many listening situations, modern FM systems provide several operating modes. The transmitter may e.g. have different microphone settings, a Bluetooth mode, or be connected to an external audio source such as a TV, MP3-player etc. and the receiver may offer a choice between getting the sound from: (1) the hearing instrument microphone alone, (2) the FM microphone alone, or (3) a combination of FM and hearing instrument microphones together.

Usually, most of the time the FM system is used in mode (3), i.e. the FM plus hearing instrument combination (often labeled "FM+M" or "FM+ENV" mode). This operating mode allows the listener to perceive the speaker's voice from the remote microphone with a good SNR while the integrated hearing instrument microphone allows to listener to also hear environmental sounds. This allows the user/listener to hear and monitor his own voice, as well as voices of other people or environmental noise, as long as the loudness balance between the FM signal and the signal coming from the hearing instrument microphone is properly adjusted. The so-called "FM advantage" measures the relative loudness of signals when both the FM signal and the hearing instrument microphone are active at the same time. As defined by the ASHA (American Speech-Language-Hearing Association 2002), FM advantage compares the levels of the FM signal and the local microphone signal when the speaker and the user of an FM system are spaced by a distance of two meters. In this example, the voice of the speaker will travel 30 cm to the input of the FM microphone at a level of approximately 80 dB-SPL, whereas only about 65 dB-SPL will remain of this original signal after traveling the 2 m distance to the microphone in the hearing instrument. The ASHA guidelines recommend that the FM signal should have a level 10 dB higher than the level of the hearing instrument's microphone signal at the output of the user's hearing instrument.

When following the ASHA guidelines (or any similar recommendation), the relative gain, i.e. the ratio of the gain applied to the audio signals produced by the FM microphone and the gain applied to the audio signals produced by the hearing instrument microphone, has to be set to a fixed value in order to achieve e.g. the recommended FM advantage of 10 dB under the above-mentioned specific conditions. Accordingly, heretofore—depending on the type of hearing instrument used—the audio output of the FM receiver has been adjusted in such a way that the desired FM advantage is either fixed or programmable by a professional, so that during use of the system the FM advantage—and hence the gain ratio—is constant in the FM+M mode of the FM receiver.

WO 02/23948 A1 relates to an example of such an FM receiver which not only receives audio signals from a remote microphone transmitter but in addition may communicate with remote devices such as a remote control or a programming unit via wireless link for data transmission.

EP 1 638 367 A2 relates to another example of an FM receiver for receiving audio signals from a remote microphone transmitter, wherein the FM receiver upon receipt of a polling signal from the remote microphone transmitter is capable of transmitting status information regarding the FM receiver to the remote microphone transmitter.

WO 97/21325 A1 relates to a hearing system comprising a remote unit with a microphone and an FM transmitter and an FM receiver connected to a hearing aid equipped with a microphone. The hearing aid can be operated in three modes, i.e. "hearing aid only", "FM only" or "FM+M". In the FM+M mode the maximum loudness of the hearing aid microphone audio signal is reduced by a fixed value between 1 and 10 dB below the maximum loudness of the FM microphone audio signal, for example by 4 dB. Both the FM microphone and the hearing aid microphone may be provided with an automatic gain control (AGC) unit.

Several scientific studies show that wireless hearing systems, such as FM systems, are extremely beneficial for hearing impaired persons. Yet, the market penetration for such systems, especially for hearing impaired adults, is by far not what one could expect. According to these studies, the main reason is the lack of appropriate counseling and training of the hearing-impaired person, so that the hearing-impaired user often is not able to utilize his wireless system in the most beneficial manner. On the other hand, the lack of counseling and training at least in part is due to a lack of information regarding how the system is used by the user.

US 2004/0190739 A1 relates to a method for recording information in a hearing device. As one example it is mentioned that the hearing device is a binaural hearing device consisting of two hearing device parts which are connected to each other via a wireless link, wherein the quality of the link is monitored and recorded as a function of time. For example, the link quality may be divided into three levels, with the present level being recorded as a function of time. Such procedure is known as "data logging".

Another example of data logging in a hearing aid is described in EP 1 367 857 A1, according to which the values of operation parameters of a hearing aid as a function of time may be recorded in the hearing aid for being read-out through a data communication interface to a host computer. The hearing aid comprises at least two microphones and a T-coil. A similar system is described in U.S. Pat. No. 6,785,394 B1.

U.S. Pat. No. 6,741,712 B2 relates to a hearing aid which is similar to that of U.S. Pat. No. 6,785,394 B1 and wherein the use time of the hearing aid is accumulated and, when a given threshold is reached, a certain action will take place, for example, deactivation of the hearing aid, provision of an alarm signal, change of parameters and/or programs, etc.

US 2004/0190737 A1 relates to a hearing aid which may be binaural and which is capable of data logging by storing parameters and information, such as hardware data, information of the fitting history of the hearing aid, operating data or current adjustments or time signals, and statistical data, in a memory provided in the hearing aid. The hearing aid comprises a connecting unit for transferring the recorded data to an external device. The selection of the data to be recorded is freely programmable.

U.S. Pat. No. 4,972,487 relates to another example of a hearing aid with data logging capability, wherein information like the number of times control programs are changed, the number of times a given control program is selected, and the total time duration for which a given program is selected, are recorded and read by an external device.

As already explained contemporary FM transmitters are designed to be versatile and intended for use in various different listening environments. For example, the transmitter may have different audio processing capabilities, for example, different degrees of acoustic beam forming, an audio input, an auxiliary microphone input and a wireless interface (e.g. Bluetooth) for connection to a mobile phone.

Such versatility is necessary to accommodate the different listening situations. However, this adds complexity for the user and this implies that an optimum use of the equipment is only warranted if the user is appropriately counseled and trained. After such a counseling session, the user goes back to his home/work environment and then it is often very difficult to trace back how the system is actually used by him.

Also, in the case of hearing impaired children, it is important that the teachers and/or the parents use the equipment appropriately. Also, in this case it is often difficult to ascertain that the equipment is used optimally in a school environment.

It is an object of the invention to provide for a method of operating a wireless hearing assistance system, which allows for optimized counseling and training of the user and/or caretaker It is a further object of the invention to provide for a corresponding hearing assistance system.

SUMMARY OF THE INVENTION

According to the invention, these objects are achieved by a method as defined in claims 1 and 46 and by a system as defined in claim 51 and 52, respectively. The invention is beneficial in that by performing data logging in the transmission and/or the receiver unit by recording the values of at least one operation parameter of the transmission and/or receiver unit as a function of time and/or by recording data derived from the values of at least one operation parameter of the transmission and/or receiver unit as a function of time and by reading the logged data from the transmission and/or receiver unit, valuable data regarding the actual use of the hearing assistance system by the user can be gathered, which is potentially very helpful for the professional in counselling and training of the user and/or caretaker.

Alternatively, the gathered information could be used by the user of the device who, for example, may use an Internet expert system which would counsel him, based on the information gathered by data logging, on how to use his system more effectively.

The data derived from the values of the at least one operation parameter of the transmission unit as a function of time may be the time-average of that parameter or it may be a time-integrated value of that parameter. The logged data may include the total time of operation of the transmission unit.

According to one embodiment, the audio signals may be analyzed by a classification unit of the transmission unit prior to being transmitted in order to determine a present auditory scene category from a plurality of auditory scene categories, wherein the logged data includes the determined auditory scene categories.

According to one embodiment, the logged data may include control commands transmitted from the transmission unit to the receiver unit, for example, parameter settings for the processing of the received audio signals in the receiver unit. In particular, the logged data may include the transmitted settings of the parameters for the processing of the received audio signals in the receiver unit, such as the value of the gain to be applied to the audio signals in the receiver unit The audio signal processing in the transmission may be carried out according to one mode presently selected from a plurality of audio signal processing modes, wherein the logged data includes the presently selected mode, the total time of use of each audio signal processing mode, the noise level for each audio signal processing mode, and/or the time-averaged signal to noise ratio for each audio signal processing mode.

The audio signal processing mode of the transmission unit may be selected manually by the user or automatically according to the result of an auditory scene analysis performed on the audio signals captured by the transmission unit. Preferably, the microphone arrangement of the transmission unit includes at least two spaced apart microphones and the audio signal processing in the transmission unit includes acoustic beam forming according to one of a plurality of beam forming modes which may be distinguished by the degree of acoustic beam forming.

The logged data may include at least one parameter used in the audio signal processing performed in the transmission unit. Rather than being captured by a microphone arrangement of the transmission unit, the audio signals also may be captured by the transmission unit from a remote source via an audio input of the transmission unit, wherein the logged data includes the total time of capturing the audio signals via the audio input. According to one embodiment, the audio signals may be captured by the transmission unit from the remote source via a wireless (e.g. Bluetooth) audio link, wherein the logged data includes the total time of capturing the audio signals via the wireless audio link from the remote source.

It is also common that one can use the audio input (or the wireless audio link from the remote source) and the microphone simultaneously, e.g. by a teacher using the microphone in order to explain/comment a movie etc. In this case, the time of such combined use may be logged.

According to one embodiment, an audio output of the receiver unit is connected to an audio input of a hearing instrument comprising the stimulation means and a microphone arrangement, wherein the audio input of the hearing instrument is in parallel to the microphone arrangement and wherein the output impedance of the receiver unit is controlled according to control commands received from the transmission unit in order to switch between a first receiver mode in which the output impedance of the receiver unit is low in order to mute the microphone arrangement of the hearing instrument and a second receiver mode in which the output impedance of the receiver unit is high in order to mix the audio signals from the receiver unit with audio signal captured by the microphone arrangement of the hearing instrument. In this case, the logged data may include the total time during which the first receiver mode is set by the transmission unit, the total time during which the second receiver mode is set by the transmission unit, the noise level in each of the first receiver mode and the second receiver mode and/or the time-averaged signal to noise ratio in each of the first receiver mode and the second receiver mode.

According to an alternative embodiment, the receiver unit may be integrated within a hearing instrument comprising the stimulation means and a microphone arrangement. According to a further alternative embodiment, the receiver unit may comprise the stimulation means.

As especially young hearing impaired children do have difficulty to report whether their FM receiver is functioning correctly, it is highly desirable that the FM transmitters that are used for children contain a "monitoring" function. This implies that the caretaker (teacher, parent) can check whether the receiver functions as intended by e.g. pushing a button on the transmitter. The receiver will then transmit its status information (e.g. signal strength, signal integrity, battery status of the receiver, loudspeaker of the receiver functioning correctly, etc.) to the FM-transmitter. The latter will display said status.

According to one embodiment, the FM system may contain such a monitoring function. Logging the data of when such monitoring occurred as well as the values (results) of such monitoring commands is of great interest to the professional who fitted the FM-equipment.

Some or all of the data might also be logged in the receiver and/or the hearing instrument.

The logged data may be read via a wired interface, such as a USB interface, or via a wireless link. In the latter case, the logged data may be read via modulation of the audio channel of the audio link, such as via a DTMF coding.

These and further objects, features and advantages of the present invention will become apparent from the following description when taken in connection with the accompanying drawings which, for purposes of illustration only, show several embodiments in accordance with the present invention.

DETAILED DESCRIPTION OF THE INVENTION

A first example of the invention is illustrated in FIGS. 1 to 6.

Figure 1:
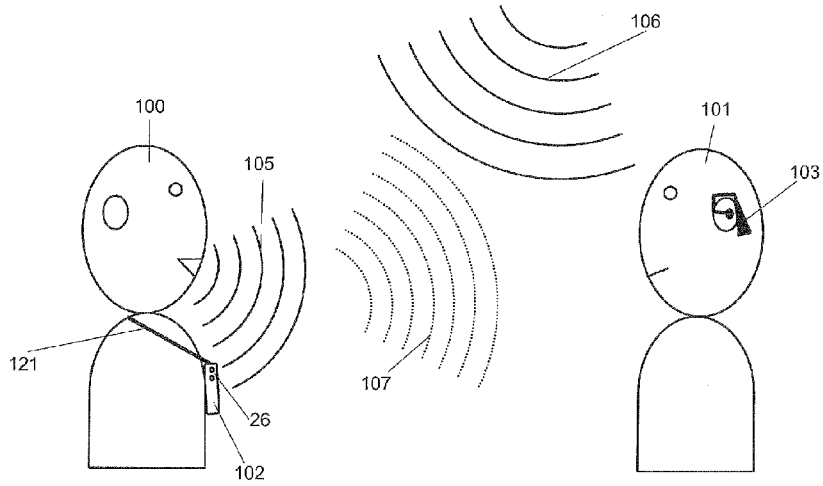
FIG. 1 is a schematic view of the use of a first embodiment of a hearing assistance system according to the invention.
Figure 5:
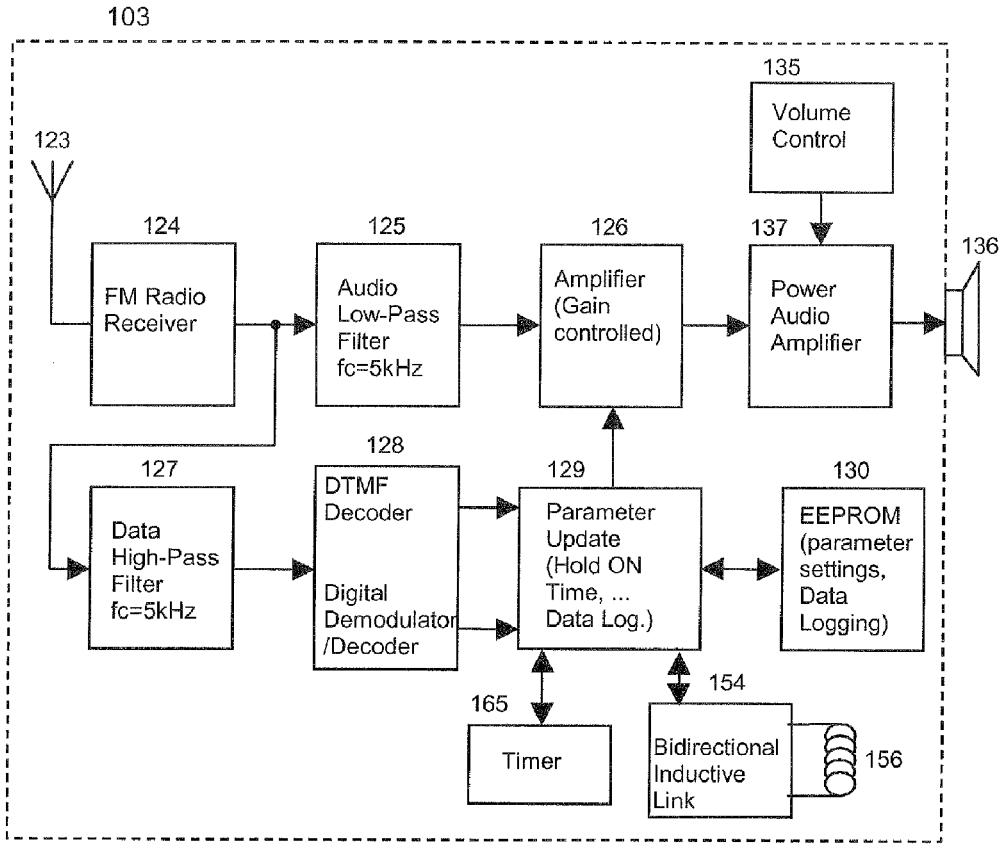
FIG. 5 is a block diagram of the receiver unit of the system of FIG. 1.

FIG. 1 shows schematically the possible use of a system for hearing assistance comprising an FM radio transmission unit 102 comprising a directional microphone arrangement 26 consisting of two omnidirectional microphones M1 and M2 which are spaced apart by a distance d, and an FM radio receiver unit 103 comprising a loudspeaker 136 (shown only in FIG. 5). The transmission unit 102 is worn by a speaker 100 around his neck by a neck-loop 121 acting as an FM radio antenna, with the microphone arrangement 26 capturing the sound waves 105 carrying the speaker's voice. Audio signals and control data are sent from the transmission unit 102 via radio link 107 to the receiver unit 103 worn by a user/listener 101. In addition to the voice 105 of the speaker 100 background/surrounding noise 106 may be present which will be both captured by the microphone arrangement 26 of the transmission unit 102 and the ears of the user 101. Typically the speaker 100 will be a teacher and the user 101 will be a normal-hearing child suffering from APD, with background noise 106 being generated by other pupils.

Other ways of using the transmission unit 102 would be e.g. (a) that the user 101 holds the transmission unit 102 in his hand, or (b) puts the transmission unit 102 on a table.

Figure 2:
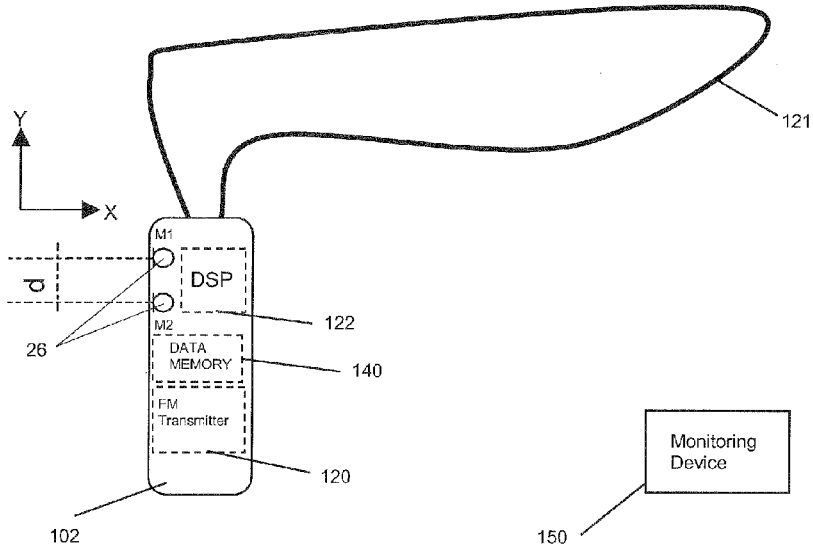
FIG. 2 is a schematic view of the transmission unit of the system of FIG. 1.

FIG. 2 is a schematic view of the transmission unit 102 which, in addition to the microphone arrangement 26, comprises a digital signal processor 122 and an FM transmitter 120.

Figure 3:
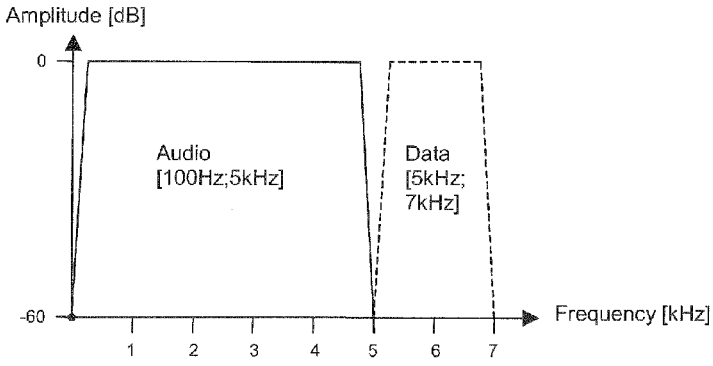
FIG. 3 is a diagram showing the signal amplitude versus frequency of the common audio signal/data transmission channel of the system of FIG. 1.

According to FIG. 3, the channel bandwidth of the FM radio transmitter 120, which, for example, may range from 100 Hz to 7 kHz, is split in two parts ranging, for example from 100 Hz to 5 kHz and from 5 kHz to 7 kHz, respectively. In this case, the lower part is used to transmit the audio signals (i.e. the first audio signals) resulting from the microphone arrangement 26, while the upper part is used for transmitting data from the FM transmitter 120 to the receiver unit 103. The data link established thereby can be used for transmitting control commands relating to the gain to be set by the receiver unit 103 from the transmission unit 102 to the receiver unit 103, and it also can be used for transmitting general information or commands to the receiver unit 103.

Figure 4:
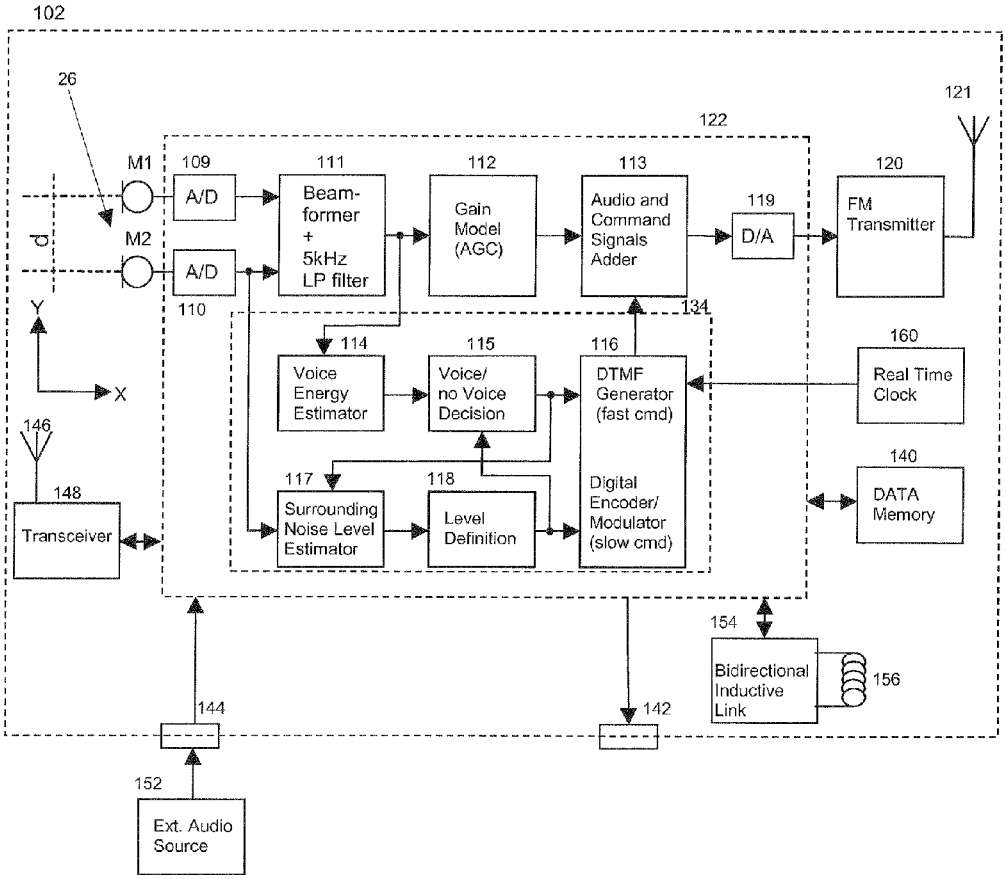
FIG. 4 is a block diagram of the transmission unit of the system of FIG. 1.

The internal architecture of the FM transmission unit 102 is schematically shown in FIG. 4. As already mentioned above, the spaced apart omnidirectional microphones M1 and M2 of the microphone arrangement 26 capture both the speaker's voice 105 and the surrounding noise 106 and produce corresponding audio signals which are converted into digital signals by the analog-to-digital converters 109 and 110. M1 is the front microphone and M2 is the rear microphone. The microphones M1 and M2 together associated to a beamformer algorithm form a directional microphone arrangement 26 which, according to FIG. 1, is placed at a relatively short distance to the mouth of the speaker 100 in order to insure a good SNR at the audio source and also to allow the use of easy to implement and fast algorithms for voice detection as will be explained in the following. The converted digital signals from the microphones M1 and M2 are supplied to the unit 111 which comprises a beam former implemented by a classical beam former algorithm and a 5 kHz low pass filter. The first audio signals leaving the beam former unit 111 are supplied to a gain model unit 112 which mainly consists of an automatic gain control (AGC) for avoiding an overmodulation of the transmitted audio signals. The output of a gain model unit 112 is supplied to an adder unit 113 which mixes the first audio signals, which are limited to a range of 100 Hz to 5 kHz due to the 5 kHz low pass filter in the unit 111, and data signals supplied from a unit 116 within a range from 5 kHz and 7 kHz. The combined audio/data signals are converted to analog by a digital-to-analog converter 119 and then are supplied to the FM transmitter 120 which uses the neck-loop 121 as an FM radio antenna.

The transmission unit 102 comprises a classification unit 134 which includes units 114, 115, 116, 117 and 118, as will be explained in detail in the following.

The unit 114 is a voice energy estimator unit which uses the output signal of the beam former unit 111 in order to compute the total energy contained in the voice spectrum with a fast attack time in the range of a few milliseconds, preferably not more than 10 milliseconds. By using such short attack time it is ensured that the system is able to react very fast when the speaker 100 begins to speak. The output of the voice energy estimator unit 114 is provided to a voice judgement unit 115 which decides, depending on the signal provided by the voice energy estimator 114, whether close voice, i.e. the speaker's voice, is present at the microphone arrangement 26 or not.

The unit 117 is a surrounding noise level estimator unit which uses the audio signal produced by the omnidirectional rear microphone M2 in order to estimate the surrounding noise level present at the microphone arrangement 26. However, it can be assumed that the surrounding noise level estimated at the microphone arrangement 26 is a good indication also for the surrounding noise level present at the ears of the user 101, like in classrooms for example. The surrounding noise level estimator unit 117 is active only if no close voice is presently detected by the voice judgement unit 115 (in case that close voice is detected by the voice judgement unit 115, the surrounding noise level estimator unit 117 is disabled by a corresponding signal from the voice judgment unit 115). A very long time constant in the range of 10 seconds is applied by the surrounding noise level estimator unit 117. The surrounding noise level estimator unit 117 measures and analyzes the total energy contained in the whole spectrum of the audio signal of the microphone M2 (usually the surrounding noise in a classroom is caused by the voices of other pupils in the classroom). The long time constant ensures that only the time-averaged surrounding noise is measured and analyzed, but not specific short noise events. According to the level estimated by the unit 117, a hysteresis function and a level definition is then applied in the level definition unit 118, and the data provided by the level definition unit 118 is supplied to the unit 116 in which the data is encoded by a digital encoder/modulator and is transmitted continuously with a digital modulation having a spectrum a range between 5 kHz and 7 kHz. That kind of modulation allows only relatively low bit rates and is well adapted for transmitting slowly varying parameters like the surrounding noise level provided by the level definition unit 118.

The estimated surrounding noise level definition provided by the level definition unit 118 is also supplied to the voice judgement unit 115 in order to be used to adapt accordingly to it the threshold level for the close voice/no close voice decision made by the voice judgement unit 115 in order to maintain a good SNR for the voice detection.

If close voice is detected by the voice judgement unit 115, a very fast DTMF (dual-tone multi-frequency) command is generated by a DTMF generator included in the unit 116. The DTMF generator uses frequencies in the range of 5 kHz to 7 kHz. The benefit of such DTMF modulation is that the generation and the decoding of the commands are very fast, in the range of a few milliseconds. This feature is very important for being able to send a very fast "voice ON" command to the receiver unit 103 in order to catch the beginning of a sentence spoken by the speaker 100. The command signals produced in the unit 116 (i.e. DTMF tones and continuous digital modulation) are provided to the adder unit 113, as already mentioned above.

The units 109 to 119 all can be realized by the digital signal processor 122 of the transmission unit 102.

The unit 160 is a Real Time Clock. It is a very low power circuit that under all circumstances keeps the exact time. The unit 160 is also connected to block 116 which transmits the time on a regular basis via the data channel to the receiver unit 103. In this way it is assured that the transmission unit 102 and the receiver unit 103 always have the same time. This even holds when the receiver unit 103 is running out of the, oftentimes, disposable battery.

The receiver unit 103 is schematically shown in FIG. 5. The audio signals produced by the microphone arrangement 26 and processed by the units 111 and 112 of transmission unit 102 and the command signals produced by the classification unit 134 of the transmission unit 102 are transmitted from the transmission unit 102 over the same FM radio channel to the receiver unit 103 where the FM radio signals are received by the antenna 123 and are demodulated in an FM radio receiver 124. An audio signal low pass filter 125 operating at 5 kHz supplies the audio signals to an amplifier 126 from where the audio signals are supplied to a power audio amplifier 137 which further amplifies the audio signals for being supplied to the loudspeaker 136 which converts the audio signal into sound waves stimulation the user's hearing. The power amplifier 137 is controlled by a manually operable volume control 135. The output signal of the FM radio receiver 124 is also filtered by a high pass filter 127 operating at 5 kHz in order to extract the commands from the unit 116 contained in the FM radio signal. A filtered signal is supplied to a unit 128 including a DTMF decoder and a digital demodulator/decoder in order to decode the command signals from the voice judgement unit 115 and the surrounding noise level definition unit 118.

The command signals decoded in the unit 128 are provided separately to a parameter update unit 129 in which the parameters of the commands are updated according to information stored in an EEPROM 130 of the receiver unit 103. The output of the parameter update unit 129 is used to control the audio signal amplifier 126 which is gain controlled. Thereby the audio signal output of the amplifier 126—and thus the sound pressure level at which the audio signals are reproduced by the loudspeaker 136—can be controlled according to the result of the auditory scene analysis performed in the classification unit 134 in order to control the gain applied to the audio signals from the microphone arrangement 26 of the transmission unit 102 according to the present auditory scene category determined by the classification unit 134.

Unit 128 also decodes the time information contained in the real time clock unit 160 of the transmission unit 102 and sent by the latter. This information is fed into a timer 165. The timer 165 is therefore (re-) synchronized on a regular basis. Relevant events occurring in the receiver unit 103 will therefore be logged with the right time, even when the user needed to exchange the, oftentimes, disposable battery of the receiver unit 103.

Figure 6:
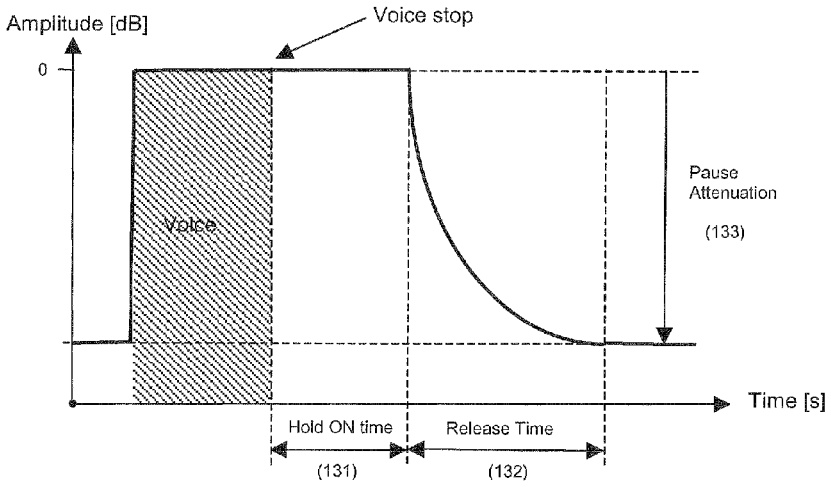
FIG. 6 is a diagram showing an example of the gain set by the gain control unit versus time.

FIG. 6 illustrates an example of how the gain set by the receiver unit 103 may be controlled according to the determined present auditory scene category.

As already explained above, the voice judgement unit 115 provides at its output for a parameter signal which may have two different values:

"Voice ON": This value is provided at the output if the voice judgement unit 115 has decided that close voice is present at the microphone arrangement 26. In this case, fast DTMF modulation occurs in the unit 116 and a control command is issued by the unit 116 and is transmitted to the amplifier 126, according to which the gain is set to a given value.

"Voice OFF": If the voice judgement unit 115 decides that no close voice is present at the microphone arrangement 26, a "voice OFF" command is issued by the unit 116 and is transmitted to the amplifier 126. In this case, the parameter update unit 129 applies a "hold on time" constant 131 and then a "release time" constant 132 defined in the EEPROM 130 to the amplifier 126. During the "hold on time" the gain set by the amplifier 126 remains at the value applied during "voice ON". During the "release time" the gain set by the amplifier 126 is progressively reduced from the value applied during "voice ON" to a lower value corresponding to a "pause attenuation" value 133 stored in the EEPROM 130. Hence, in case of "voice OFF" the gain of the microphone arrangement 26 is reduced relative to the gain of the microphone arrangement 26 during "voice ON". This ensures an optimum SNR of the sound signals present at the user's ear, since at that time no useful audio signal is present at the microphone arrangement 26 of the transmission unit 102, so that user 101 may perceive ambient sound signals (for example voice from his neighbor in the classroom) without disturbance by noise of the microphone arrangement 26.

The control data/command issued by the surrounding noise level definition unit 118 is the "surrounding noise level" which has a value according to the detected surrounding noise level. As already mentioned above, according to one embodiment the "surrounding noise level" is estimated only during "voice OFF" but the level values are sent continuously over the data link. Depending on the "surrounding noise level" the parameter update unit 129 controls the amplifier 126 such that according to the definition stored in the EEPROM 130 the amplifier 126 applies an additional gain offset to the audio signals sent to the power amplifier 137. According to alternative embodiments, the "surrounding noise level" is estimated only or also during "voice ON". In these cases, during "voice ON", the parameter update unit 129 controls the amplifier 126 depending on the "surrounding noise level" such that according to the definition stored in the EEPROM 130 the amplifier 126 applies an additional gain offset to the audio signals sent to the power amplifier 137.

The difference of the gain values applied for "voice ON" and "voice OFF", i.e. the dynamic range, usually will be less than 20 dB, e.g. 12 dB.

In all embodiments, the present auditory scene category determined by the classification unit 134 may be characterized by a classification index.

In general, the classification unit will analyze the audio signals produced by the microphone arrangement 26 of the transmission unit 102 in the time domain and/or in the frequency domain, i.e. it will analyze at least one of the following: amplitudes, frequency spectra and transient phenomena of the audio signals.

According to FIG. 4, the transmission unit 102 in addition to the microphone arrangement 26 may comprise an audio signal input 144 for connecting an external audio signal source 152 by a wired connection to the transmission unit 102 in order to transmit audio signals provided from such external audio signal source via the FM link, i.e. the FM transmitter 120 and the antenna 121, to the receiver unit 103. During times when an external audio signal source is connected to the audio input 144, the microphone arrangement 26 can either be muted or active (e.g. a teacher commenting a movie). The external audio signal source 152 may be, for example, a music player, a telephone receiver, a mobile phone, or a radio receiver.

In addition, the transmission unit 102 may comprise an antenna 146 and a transceiver 148 for receiving and transmitting audio signals from/to an external audio signal source 152 via a wireless link, (e.g. Bluetooth). A typical example is a Bluetooth communication with a cell-phone or a laptop. In that case, the FM transmission unit 102 relays the Bluetooth signal to the FM receiver units 103 (connected to the hearing aids of a hearing impaired person) and the hearing impaired person can use the FM-transmitter to talk back to the cell-phone. Besides being hands-free, this technology allows many hearing impaired users to use cell phones. (no whistling or bad acoustical coupling between cell phone and hearing aid)

Further, the transmission unit 102 and the receiver unit 103 are designed such that a wireless, preferably inductive, bidirectional data link is established which serves as a "monitoring channel". A polling signal is sent from the transmission unit 102 to the receiver unit 103, whereupon the receiver unit 103 sends status information data regarding the status of the receiver unit 103 to transmission unit 102. The status information may include the following: the average received audio signal strength; whether there is or has been any interference and to what extent; whether the loudspeaker 136 is blocked by ear wax, and whether the battery is functioning correctly. For establishing such inductive, bidirectional data link both the transmission unit 102 and the receiver unit 103 are provided with a transceiver unit 154 and an inductive antenna 156.

According to the invention, the transmission unit 102 and/or the receiver unit 103 are provided with data logging capability. In order to provide the transmission unit 102 with data logging capability, the transmission unit 102 comprises a data memory 140 which is connected to the digital signal processor for recording the values of at least one operation parameter of the transmission unit 102 as a function of time and/or for recording data derived from values of at least one operation parameter of the transmission unit 102 as a function of time. The data stored in the memory 140 may be read by an external device 150 (not yet shown) via a data output 142, such as a mini-USB. Alternatively or in addition the external device 150 and the transmission unit 102 may be designed for transmitting the logged data from the memory 140 via a wireless link, for example, a Bluetooth link or a modulation of the audio channel, for example, via DTMF coding. Such wireless link may utilize the antenna 121 and the transmitter 120 of the transmission unit 102. The logged data gathered by the external device 150 from the transmission unit 102 may be used by the professional for improved counseling and training of the user 101. Alternatively, the logged data may be used by the user 101 himself, who, for example, may feed the data to an internet expert system which would counsel him, based on the logged data, on how to use his system more efficiently.

The logged data with regard to the transmission unit 102 may include the following:

- the total time of operation of the transmission unit 102;
- the auditory scene categories determined by the classification unit 134 as a function of time;
- the control commands generated by the classification unit 134 and sent to the receiver unit 103, in particular parameter settings such as the gain to be applied by the receiver unit 103;
- the presently selected audio signal processing mode of the transmission unit 102, in particular the kind or degree of acoustic beam forming performed by the beam former 111;
- the total time of use of each of such audio signal processing modes;
- the acoustic noise level for each audio signal processing mode;
- the time-averaged signal to noise ratio for each audio signal processing mode;
- the total time of capturing the audio signals via the audio input 144;
- the total time of capturing the audio signals via the receiver 148 from the remote audio signal source;
- the time when the monitoring of the receiver unit 103 was requested as well as the result of this request.

Figure 7:
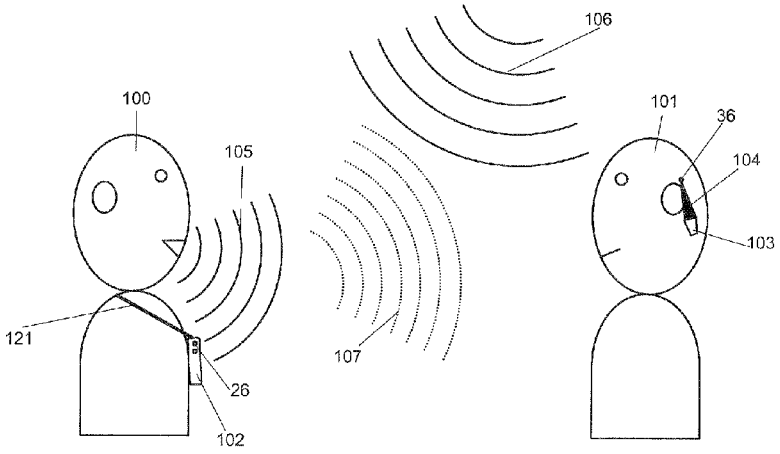
FIG. 7 is a schematic view of the use of a second embodiment of a hearing assistance system according to the invention.

The logged data with regard to the receiver unit 103 may include the following:

- the average received signal strength
- whether there has been any interference and to what extent
- whether the loudspeaker 136 was blocked by ear wax
- whether the battery was functioning correctly
- when and how often the monitoring function has been used FIG. 7 shows schematically the use of an alternative embodiment of a system for hearing assistance, wherein the receiver unit 103 worn by the user 101 does not comprise an electroacoustic output transducer but rather it comprises an audio output which is connected, e.g. by an audio shoe (not shown), to an audio input of a hearing instrument 104, e.g. a hearing aid, comprising a microphone arrangement 36. The hearing aid could be of any type, e.g. BTE (Behind-the-ear), ITE (In-the-ear) or CIC (Completely-in-the-channel).

Figure 8:
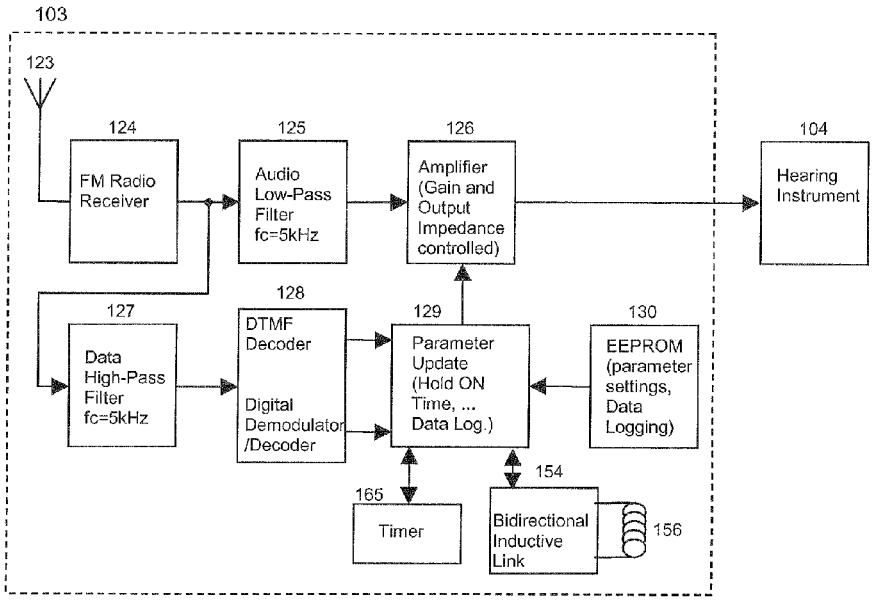
FIG. 8 is a block diagram of the receiver unit of the system of FIG. 7.

In FIG. 8 a block diagram of the receiver unit 103 connected to the hearing instrument 104 is shown. Apart from the features that the amplifier 126 is both gain and output impedance controlled and that the power amplifier 137, the volume control 135 and the loudspeaker 136 are replaced by an audio output, the architecture of the receiver unit 103 of FIG. 8 corresponds to that of FIG. 7.

Figure 9:
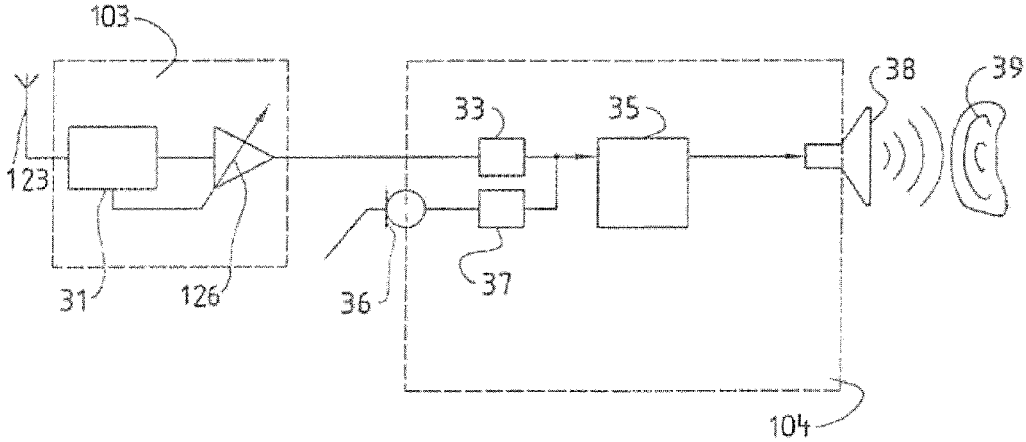
FIG. 9 shows schematically an example in which the receiver unit is connected to a separate audio input of a hearing instrument.

FIG. 9 is a block diagram of an example in which the receiver unit 103 is connected to a high impedance audio input of the hearing instrument 104. In FIG. 9 the signal processing units of the receiver unit 103 of FIG. 8 are schematically represented by a module 31. The processed audio signals are amplified by the variable gain amplifier 126. The output of the receiver unit 103 is connected to an audio input of the hearing instrument 104 which is separate from the microphone 36 of the hearing instrument 15 (such separate audio input has a high input impedance).

The first audio signals provided at the separate audio input of the hearing instrument 104 may undergo pre-amplification in a pre-amplifier 33, while the audio signals produced by the microphone 36 of the hearing instrument 104 may undergo pre-amplification in a pre-amplifier 37. The hearing instrument 104 further comprises a digital central unit 35 into which the audio signals from the microphone 36 and the audio input are supplied as a mixed audio signal for further audio signal processing and amplification prior to being supplied to the input of the output transducer 38 of the hearing instrument 104. The output transducer 38 serves to stimulate the user's hearing 39 according to the combined audio signals provided by the central unit 35.

Since pre-amplification in the pre-amplifiers 33 and 37 is not level-dependent, the receiver unit 103 may control—by controlling the gain applied by the variable gain amplifier 126—also the ratio of the gain applied to the audio signals from the microphone arrangement 26 and the gain applied to the audio signals from the microphone 36.

Figure 10:
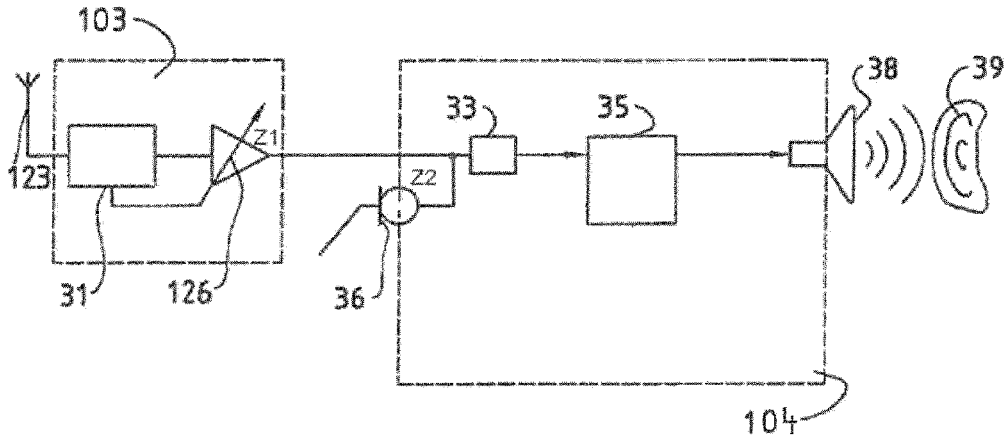
FIG. 10 shows schematically an example in which the receiver unit is connected in parallel to the microphone arrangement of a hearing instrument.

FIG. 10 shows a modification of the embodiment of FIG. 9, wherein the output of the receiver unit 103 is not provided to a separate high impedance audio input of the hearing instrument 104 but rather is provided to an audio input of the hearing instrument 104 which is connected in parallel to the hearing instrument microphone 36. Also in this case, the audio signals from the remote microphone arrangement 26 and the hearing instrument microphone 36, respectively, are provided as a combined/mixed audio signal to the central unit 35 of the hearing instrument 104. The gain ratio for the audio signals from the receiver unit 103 and the microphone 36, respectively, can be controlled by the receiver unit 103 by accordingly controlling the signal at the audio output of the receiver unit 103 and the output impedance Z1 of the audio output of the receiver unit 103, i.e. by controlling the gain applied to the audio signals by the amplifier 126 in the receiver unit 103.

Figure 11:
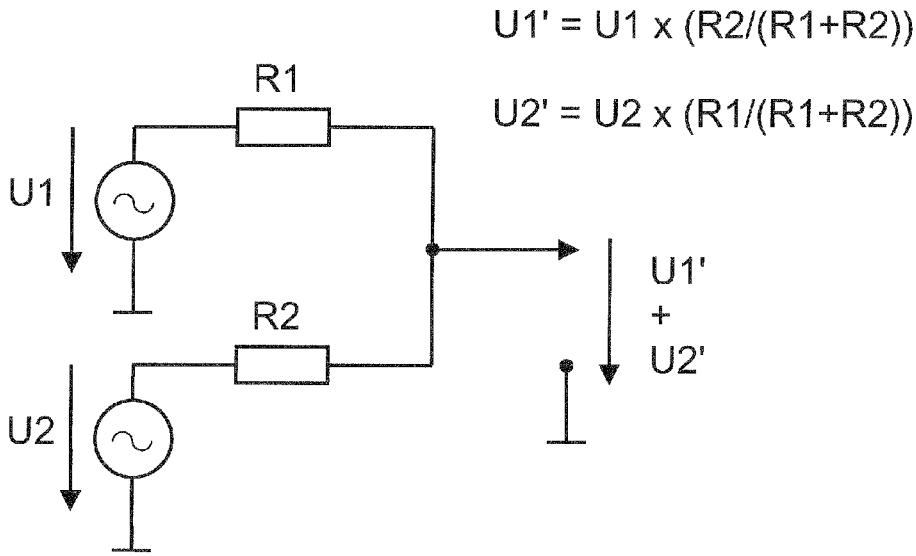
FIG. 11 is a schematic block diagram illustrating how the first and second audio signals in the embodiment of FIG. 10 are mixed and how the gain ratio can be controlled.

FIG. 11 is a schematic representation of how such gain ratio control is can be realized. In the representation of FIG. 12, U1 is the signal at the audio output of the receiver unit 103, Z1 is the audio output impedance of the receiver unit 103, U2 is the audio signal at the output of the second microphone 36, Z2 is the impedance of the second microphone 36, and R1 is an approximation of Z1, while R2 is an approximation of Z2, which in both cases is a good approximation for the audio frequency range of the signals. $U_{out}$ is the combined audio signal and is given by U1'+U2', which, in turn, is given by $$U1\times(R2/(R1+R2))+U2\times(R1/(R1+R2)).$$

Consequently, the amplitude U1 and the impedance Z1(R1) of the output signal of the receiver unit 103 will determine the ratio of the amplitude U1 (i.e. the amplitude of the first audio signals from the remote microphone 26) and U2 (i.e. the amplitude of the second audio signals from the hearing instrument microphone 36), since the impedance Z2(R2) of the microphone 36 typically is 3.9 kOhm and the sensitivity of the microphone 36 is calibrated.

This means that in the case of an audio input in parallel to the second microphone 36 the audio signal U2 of the hearing instrument microphone 36 can be dynamically attenuated according to the control signal from the classification unit 134 by varying the amplitude U1 and the impedance Z1(R1) of the audio output of the receiver unit 103.

The transmission unit to be used with the receiver unit of FIG. 8 corresponds to that shown in FIG. 5. In particular, also the gain control scheme applied by the classification unit 134 of the transmission unit 102 may correspond to that shown in FIG. 6.

The permanently repeated determination of the present auditory scene category and the corresponding setting of the gain ratio allows to automatically optimize the level of the first audio signals and the second audio signals according to the present auditory scene. For example, if the classification unit 134 detects that the speaker 100 is silent, the gain for the audio signals from the remote microphone 26 may be reduced in order to facilitate perception of the sounds in the environment of the hearing instrument 104—and hence in the environment of the user 101. If, on the other hand, the classification unit 134 detects that the speaker 100 is speaking while significant surrounding noise around the user 101 is present, the gain for the audio signals from the microphone 26 may be increased and/or the gain for the audio signals from the hearing instrument microphone 36 may be reduced in order to facilitate perception of the speaker's voice over the surrounding noise.

Attenuation of the audio signals from the hearing instrument microphone 36 is preferable if the surrounding noise level is above a given threshold value (i.e. noisy environment), while increase of the gain of the audio signals from the remote microphone 26 is preferable if the surrounding noise level is below that threshold value (i.e. quiet environment). The reason for this strategy is that thereby the listening comfort can be increased.

As shown above, by connecting the output of the receiver unit 103 in parallel to the microphone of the hearing instrument 104 it is possible to mute the microphone 36 of the hearing instrument by transmitting a corresponding control command from the transmission unit 102 to the receiver unit 103. Thereby the mode of operation of the hearing instrument 104 with regard to the receiver unit 103 (either "FM-only" mode or "FM+M" mode) can be controlled by the transmission unit 102. In this case, the data logging in the transmission unit 102 in addition may include the following parameters:

- total time of use in the FM-only mode;
- total time of use in the FM+M mode;
- noise level and average signal to noise ratio for each mode;
- the gain applied to the audio signals in the receiver unit 102 (i.e. the "FM advantage") in the FM+M mode.

Besides being controlled by the transmitter, it is also possible that the users makes the selection between the different FM modes. In that case, data logging with regard to the receiver unit 103, may in addition include:

- total time of use in the FM-only mode;
- total time of use in the FM+M mode;

In addition to the gain control provided by the classification unit 134 the transmission unit 102 may be designed to enable determination of an optimum value of the gain set by the gain control unit 126 in order to calibrate the gain control unit 126. To this end, the transmission unit 102 may be provided with means for generating test audio signals which are transmitted at a predefined level to the receiver unit 102 and with means for transmitting gain control commands for the transmission unit 102 to the gain control unit 126 in order to selectively change the gain set by the gain control unit 126. For example, the transmission unit 102 may be provided with buttons which serve to increase or decrease the gain until the user 101 of the hearing instrument 104 feels that the presently applied gain is at an optimum value, with this optimum gain value then being stored in the transmission unit 102 and/or the receiver unit 103. An example of such a system is described in the European patent application No. 06 004 230.6.

While systems comprising a classification unit 134 in order to dynamically adapt the gain to the present auditory scene, as described above, are preferred, the data logging features of the present invention also can be applied to FM systems operated at constant gain. However, the constant gain value preferably is determined by the adjustment procedure described above in order to be able to operate the receiver unit 103 at the optimum value of the gain applied to the audio signals received from the transmission unit 102.

In addition to the above-described storing of the logged data taking place in the transmission unit 102 one may also may store logged data in the receiver unit 103 or in the hearing instrument 104. Thereby for example the quality/strength of the link from the transmission unit 102 to the receiver unit 103 (received signal strength indication (RSSI)) and/or the average improvement in signal-to-noise ratio (i.e. the difference in signal-to-noise ratio that would be obtained by the hearing instrument 104 without the receiver unit 103 being used and the signal-to-noise ratio obtained with the receiver 103 being used) could be recorded in the receiver unit 103 or the hearing instrument 104. Further, data to be logged may be sent over the digital part of the wireless link from the transmission unit 102 to the receiver unit 103 for being stored there or in the hearing instrument 104. While in the above embodiments the receiver unit 24, 103 and the hearing instrument 15, 104 have been shown as separate devices connected by some kind of plug connection (usually an audio shoe) it is to be understood that the functionality of the receiver unit 24, 103 also could be integrated with the hearing instrument 15, 104, i.e. the receiver unit and the hearing instrument could form a single device.

It is also understood that the receiver unit 103 and/or the hearing aid 104 may communicate wirelessly, e.g. via the monitoring channel, with either the transmission unit 102 or an external device in order to read out the logged data stored in the receiver unit 103 and/or the hearing aid 104. Alternatively, the logged data may be read out via the normal programming plug. The transmission unit 102 may be designed for use as a remote device spaced apart from the user 101, as shown in FIGS. 1 and 7, e.g. for use by a teacher in a classroom or as a desktop device in a meeting. Alternatively or in addition, the transmission unit 102 may be designed for being worn somewhere at the user's body apart from his head, for example by a loop around the user's neck (used e.g. while using the device as a handsfree device for cell phone use).

While various embodiments in accordance with the present invention have been shown and described, it is understood that the invention is not limited thereto, and is susceptible to numerous changes and modifications as known to those skilled in the art. Therefore, this invention is not limited to the details shown and described herein, and includes all such changes and modifications as encompassed by the scope of the appended claims.

What is claimed is:

1. A method of operating a system for providing hearing assistance to a user, comprising:

(a) capturing and processing audio signals by a transmission unit and transmitting said audio signals from said transmission unit via a wireless audio link to a receiver unit;

(b) processing the received audio signals in said receiver unit;

(c) stimulating a hearing of said user, by stimulating means worn at or in an ear of said user, according to said processed audio signals from said receiver unit;

(d) logging data by at least one of recording values of at least one operation parameter of at least one of said transmission unit and said receiver unit as a function of time and recording data derived from values of at least one operation parameter of at least one of said transmission unit and said receiver unit as a function of time in said transmission unit; and (e) reading said logged data from said transmission unit.

2. The method of claim 1, wherein said transmission unit is a remote device used spaced apart from said user by another person.

3. The method of claim 1, wherein said transmission unit is a device which is worn at a body of said user spaced apart from a head of said user and used by said user.

4. The method of claim 1, wherein said data derived from said values of at least one operation parameter of said transmission unit as a function of time is a time-average of said least one operation parameter.

5. The method of claim 1, wherein said data derived from said values of at least one operation parameter of said transmission unit as a function of time is a time-integrated value of said least one operation parameter.

6. The method of claim 5, wherein said logged data includes a total time of operation of said transmission unit.

7. The method of claim 1, wherein the audio signals are analyzed by a classification unit of said transmission unit prior to being transmitted in order to determine a present auditory scene category from a plurality of auditory scene categories.

8. The method of claim 7, wherein said logged data includes said determined auditory scene categories.

9. The method of claim 1, wherein said receiver unit is integrated within a hearing instrument comprising said stimulation means and a microphone arrangement.

10. The method of claim 1, wherein said receiver unit comprises said stimulation means.

11. The method of claim 1, wherein said logged data is read via a wired interface.

12. The method of claim 1, wherein said logged data is read via a wireless link.

13. The method of claim 12, wherein said logged data is read via a modulation of an audio channel of said audio link.

14. The method of claim 1, wherein said logged data read from said transmission unit is supplied as input to an internet expert system.

15. The method of claim 1, wherein data to be logged in said transmission unit is sent via a wireless data link from said receiver unit to said transmission unit.

16. The method of claim 15, wherein said wireless data link is part of a bidirectional data link between said transmission unit and said receiver unit for sending a polling signal from said transmission unit to said receiver unit, whereupon status information data regarding operation of said receiver unit is sent from said receiver unit to said transmission unit order to monitor a status of said receiver unit.

17. The method of claim 16, wherein said logged data includes at least one of status information data regarding said status of said receiver unit as a function of time and the times of sending said polling signal.

18. The method of claim 16, wherein said status information data includes at least one of a signal strength of said audio link, a presence and an extent of interfering signals, a battery status of said receiver unit and the proper functioning of said stimulating means.

19. The method of claim 1, wherein a real time clock signal is generated in said transmission unit and is regularly sent via a wireless data channel from said transmission unit to said receiver unit in order to regularly synchronize a timer of said receiver unit to said clock signal of said transmission unit.

20. A system for providing hearing assistance to a user, comprising: a transmission unit for capturing and processing audio signals and transmitting said audio signals via a wireless audio link, a receiver unit for receiving and processing said audio signals from said transmission unit via said wireless link; stimulating means worn at or in an ear of said user for stimulating a hearing of said user according to said processed audio signals from said receiver unit, means for logging data by at least one of recording values of at least one operation parameter of at least one of said transmission unit and said receiver unit as a function of time and recording data derived from the values of at least one operation parameter of at least one of said transmission unit and said receiver unit as a function of time in said transmission unit; and means for reading said logged data from said transmission unit.

* * * * *